United States Patent [19]

Dukel et al.

[11] 4,302,039

[45] Nov. 24, 1981

[54] STRIKING BOX FOR RETAINING THE BOLT OF A DOOR LOCK

[75] Inventors: Cornelis Dukel; Pieter Hoogerheide, both of The Hague; Jan G. C. Niehaus, Leidschendam, all of Netherlands

[73] Assignee: Staat der Nederlanden (Staatsbedrijf der Posterijen, Telegrafie en Telefonie), The Hague, Netherlands

[21] Appl. No.: 60,510

[22] Filed: Jul. 25, 1979

[51] Int. Cl.[3] ..... E05C 13/02

[52] U.S. Cl. ..... 292/341.16

[58] Field of Search ..... 292/341.16, 201, 341.17, 292/341.15

[56] References Cited

U.S. PATENT DOCUMENTS

| | | | |
|---|---|---|---|
| 813,119 | 2/1906 | Smith | 292/341.16 |
| 4,017,107 | 4/1977 | Hanchett | 292/341.16 |

*Primary Examiner*—Richard E. Moore

*Attorney, Agent, or Firm*—Hugh Adam Kirk

[57] ABSTRACT

Striking box for retaining the bolt of a door lock, comprising a bolt stop, an activating device for moving the bolt stop, a signalling switch and a mechanism mounted between the activating device and the bolt stop which ensures that the movement of the bolt stop is at first either prevented or delayed. The path of the bolt stop is crossed by a latch which is not directly connected to the bolt stop. The activating device and the latch are coupled so that the latch operates the signalling switch (28) before the bolt stop releases the bolt and after the bolt stop retains the bolt.

8 Claims, 9 Drawing Figures

IV
IV

STRIKING BOX FOR RETAINING THE BOLT OF A DOOR LOCK

BACKGROUND OF INVENTION

A striking box of this kind is known from Dutch Pat. No. 152,626 or British Pat. No. 1,515,531 for night lock bolts on doors in prisons.

Previously such a mechanism comprised a toggle-joint lever and the signalling switch is operated by the bolt stop.

This made it possible, when the bolt stop is retracted, to insert a piece of cardboard or a similar object in the striking box with the result that, in the position blocked by the toggle-switch lever, the latter cannot fully reach the rest position, and the bolt stop is so close to its end position that the signalling switch is operated. The striking box then appears to be closed, but the bolt stop can be pushed back. Besides this indicated abuse, accumulated dirt can also cause this malfunction.

SUMMARY OF THE INVENTION

The object of the invention is to eliminate this drawback, and this has been achieved by providing a latch which is not directly connected to the bolt stop, and which latch moves in a path crossing the path of the bolt stop. The activating device and the latch are coupled together so that the latch operates the signalling switch.

The invention is not limited to a striking box in which the mechanism is formed by a toggle-switch lever. Nor does the bolt stop have to be movable backwards and forwards in a straight line in the same direction as the bolt when the door is being locked. In addition, the bolt stop does not have to be shaped like a cage, which limitation applies to the Dutch patent mentioned above.

The activating device preferably comprises a rotary magnet having a crank coupling it to the bolt stop with space for motion. According to a suitable embodiment, the bolt stop is a lever hinged in a fixed point.

The latch can be operated by an electro magnet which is electrically coupled to the activating device. In a different embodiment the latch has a run-on or cam edge lying in the path of the crank and can be pushed away by the crank against the action of a spring.

BRIEF DESCRIPTION OF THE VIEWS

The above mentioned and other features, objects and advantages, and the manner of attaining them are described more specifically below by reference to embodiments of this invention shown in the accompanying drawings wherein.

Figures 1, 2, 3, 4:
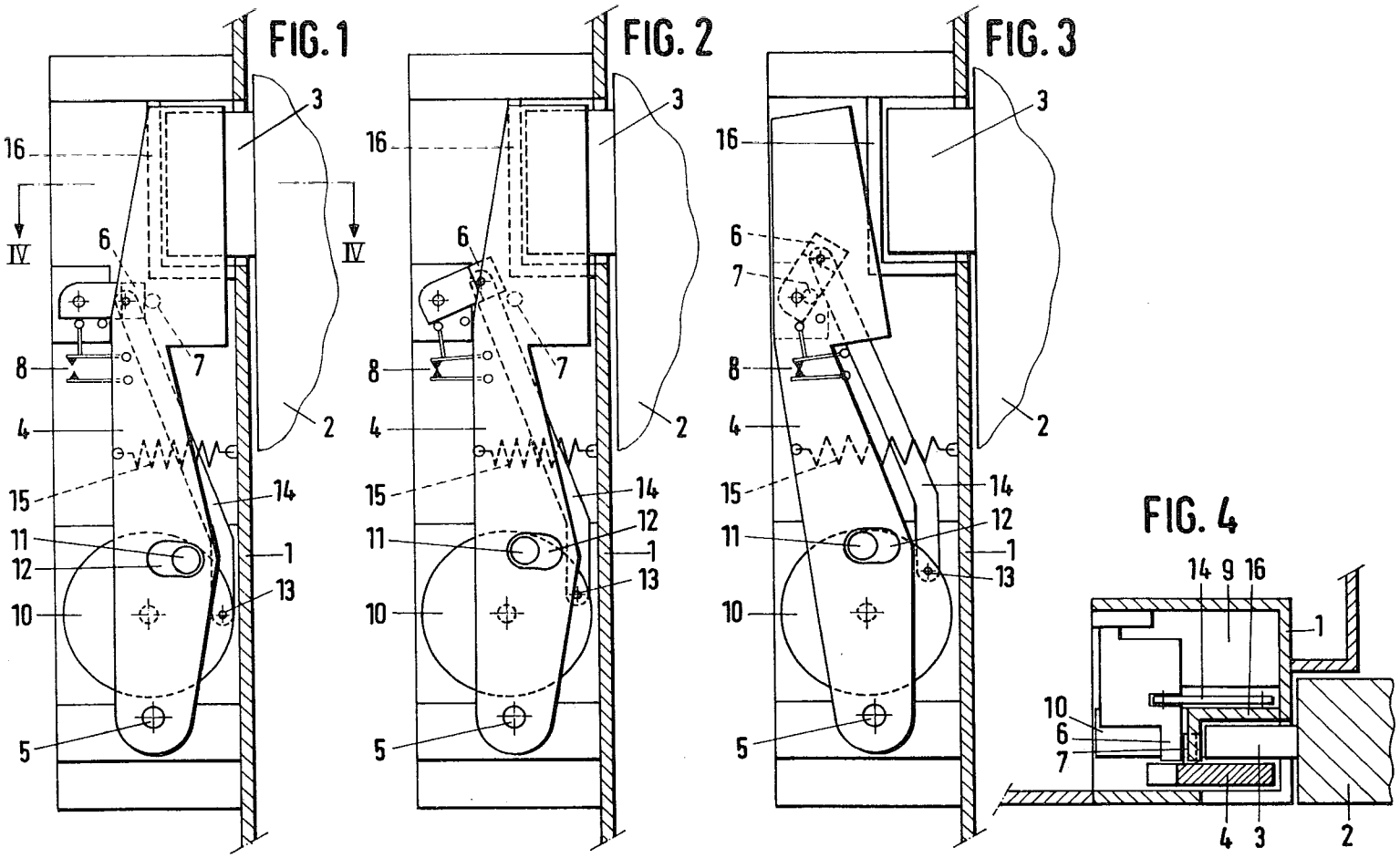
FIG. 1 is a vertical cross section of a striking box according to one embodiment of this invention with a swivelling bolt stop in the closed and latched position.
FIG. 2 shows the striking box of FIG. 1 in the closed and unlatched position.
FIG. 3 shows the striking box of FIG. 1 in the open position.
FIG. 4 is a transverse section taken along line IV—IV in FIG. 1.

FIGS. 1-4 show a striking box; in FIGS. 1-3 a side plate has been removed. To the right of front plate 1 is a closed door 2 with a door lock having a bolt 3. In the closed position of the striking box the bolt 3 is covered by a bolt stop formed by a lever 4 hinging on a spindle 5. Lever 4 has a pin 7 which can operate together with a swivelling latch 6. Latch 6 can operate a signalling switch 8. A rotary magnet 9, the crank of which is formed by a flywheel 10, constitutes the activating device operating lever 4 by means of a pin 11 on the flywheel engaging a hole 12 in lever 4 which hole leaves space for motion of the pin 11. Latch 6 is operated by flywheel 10 via a pivot 13 and a link 14.

In the position shown in FIGS. 1 and 4, the bolt stop 4 keeps bolt 3 locked in. The bolt stop 4 is locked in its place because latch 6 is behind pin 7. Signalling switch 8 is open.

For opening the striking box, rotary magnet 9 is energized. Flywheel 10 starts turning counter-clockwise. This causes latch 6 to be lifted via pivot 13 and link 14, so that pin 7 is released and signalling switch 8 is closed. Meanwhile, pin 11 traverses hole 12 while lever 4 remains in its rest position. This situation is shown in FIG. 2. Subsequently, pin 11 pushes lever 4 to the left against the action of a draw spring 15, supported by the energy accumulated in flywheel 10. Now the situation shown in FIG. 3 has arisen, in which bolt 3 is unobstructed.

After door 2 has been opened the space containing the moving parts is not accessible, owing to the presence of a cover 16 see FIG. 4.

When the striking box is closed again, lever 4 follows pin 11 under the influence of spring 15. After the lever has arrived in its end position, link 14 moves latch 6 behind pin 7 and switch 8 is opened.

Figure 5:
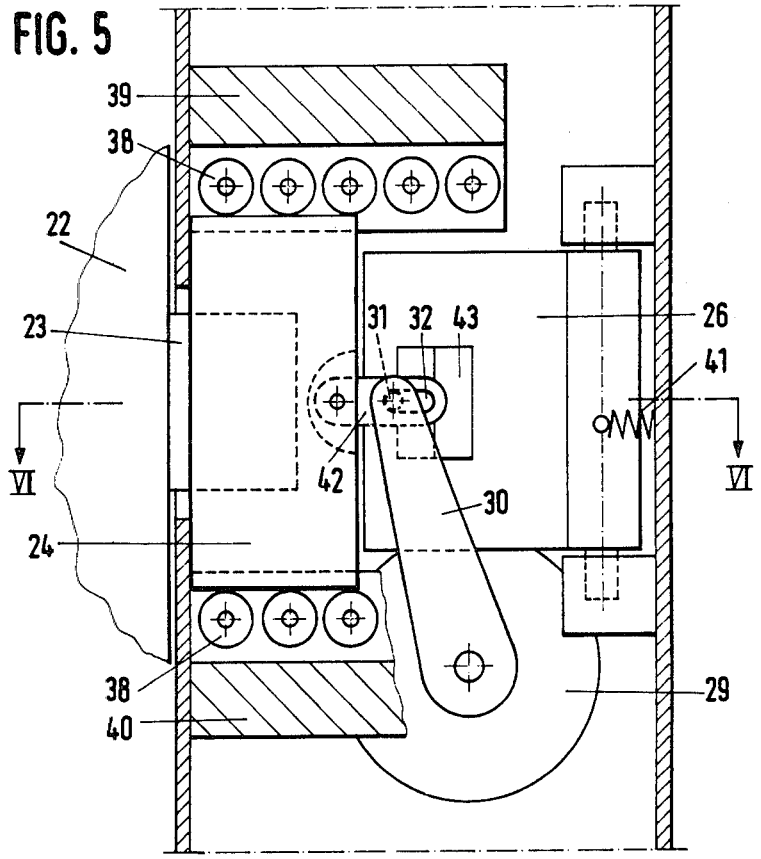
FIG. 5 is a cross section of another embodiment of the striking box according to this invention with a bolt stop movable along a straight line.
Figure 6:
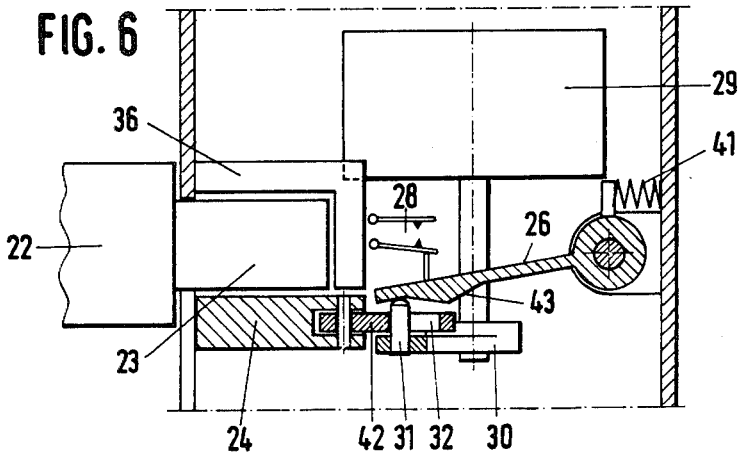
FIG. 6 is a transverse section taken along line VI—VI in FIG. 5.

In FIGS. 5 and 6 the reference numbers for parts corresponding or comparable with those in FIGS. 1-4 have been obtained by increasing the numbers in FIG. 1 by 20.

Lever 4 in FIG. 1, which constitutes the bolt stop, has been replaced in FIG. 5 by a bolt stop 24 movable in a straight line, which is guided by rollers 38 in blocks 39 and 40. In the position shown in FIGS. 5 and 6 the striking box is closed; bolt stop 24 covers bolt 23 of door 22. Bolt stop 24 is blocked by a swivelling latch 26. This latch works together with a signalling switch 28. The latch is pressed against a pin 31 by a compression spring 41. Pin 31 is fitted on a crank 30 of a rotary magnet 29. It engages a hole 32 in link 42 fitted to bolt stop 24, the hole leaving space for motion.

The operation of this embodiment is as follows. For opening the striking box, rotary magnet 29 is energized, which causes crank 30 to start turning clockwise. As a result, latch 26 is pushed upwards via pin 31 and run-on cam edge 43 on the latch, whereby switch 28 is closed while pin 31 traverses hole 32. Next, bolt stop 24 is moved to the right via link 42, the latch laying itself against bolt stop 24 with run-on edge 43, and the bolt-stop moving underneath the run-on edge. The bolt is now unobstructed.

After door 22 has been opened the space containing the moving parts is not accessible, owing to the presence of a cover 36.

Figure 7:
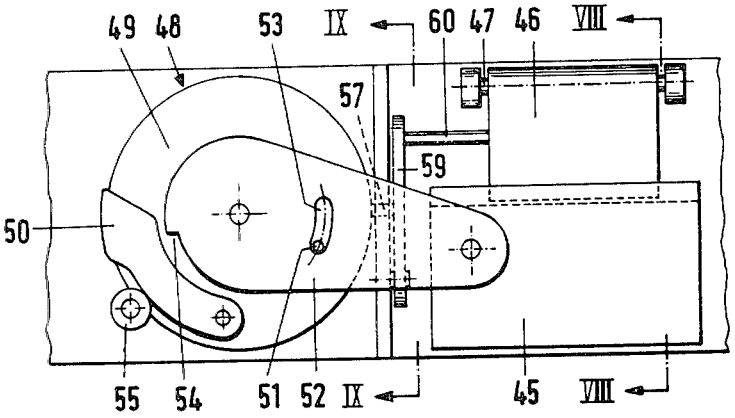
FIG. 7 is a side view of still another embodiment of a striking box according to this invention without extra springs.
Figure 8:
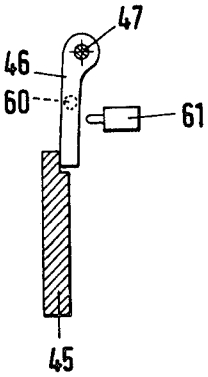
FIG. 8 is a cross section taken along line VIII—VIII of FIG. 7.
Figure 9:
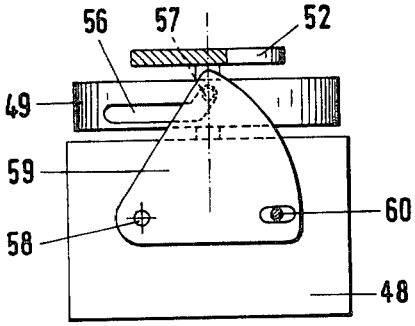
FIG. 9 is a cross section taken along line IX—IX of FIG. 7.

FIGS. 7, 8 and 9 show a third embodiment of the device according to the invention. This embodiment has no other springs than those in the rotary magnet, which enhances the reliability and reduces the risk of abuse and damage.

FIG. 7 shows a bolt stop 45 in latched position. A latch 46 which pivots on a spindle 47 has to be turned away before the bolt stop can be moved. A flywheel 49 has been fitted on the spindle of a rotary magnet 48 (not shown in FIGS. 8 and 9). The flywheel is provided with a pawl 50 and a pin 51. An arm 52 can swivel on the spindle of rotary magnet 48. Arm 52 has a hole 53 providing two stops for pin 51. At the end of arm 52 a recess 54 has been provided which can operate together with pawl 50. Pawl 50 can also work together with a stationery roller 55. Flywheel 49 has a peripheral run-on or cam slot 56. A cam follower or pin 57 fitted to a segment 59, which swivels on a fixed pivot 58, works together with slot 56. Segment 59 operates latch 46 via a link 60. A signalling switch 61 has been mounted near the latch; the switch operates when latching and unlatching takes place.

This embodiment operates as follows.

When rotary magnet 48 is energized, segment 59 is turned clockwise by run-on or cam slot 56 and cam follower or pin 57 (FIG. 9). This causes latch 46 to be turned out of the path of bolt stop 45, so that signalling switch 61 is operated.

Meanwhile pawl 50 has been advanced between roller 55 and recess 54 and pin 51 has reached the other stop in hole 53. Arm 52 is now taken along and bolt 45 is moved.

When energization of the rotary magnet is discontinued, flywheel 49 returns to its normal position. This causes pawl 50 to move along roller 55, so that the pawl presses against the end of recess 54, taking along arm 52, which in turn takes bolt stop 45 back to its normal position. At the end of the movement of flywheel 49, segment 59 turns backwards, causing latch 46 to block bolt stop 45. Again, signalling switch 61 is operated.

Within the framework of the invention many embodiments are possible. For example, the latch might be coupled to the activating device electrically instead of mechanically.

Contrary to the embodiment according to the patent mentioned, the embodiments described can be used without any adaptation for doors opening clockwise and counter-clockwise when viewed from above.

While there is described above the principles of this invention in connection with specific apparatus, it is to be clearly understood that this description is made only by way of example and not as a limitation to the scope of this invention.

What we claim is:

1. Striking box for retaining the bolt of a door lock, comprising a bolt stop (4, 24, 45), an activating device (9, 29, 48) for moving said bolt stop, a mechanism mounted between said activating device and said bolt stop which ensures that the movement of said bolt stop is at first prevented, said mechanism comprising a latch (6, 26, 46) which moves in a path crossing the path of said bolt stop, said latch being coupled to and operated by said activating device, and a signalling switch (8, 28, 61) operated by said activating device prior to operating said bolt stop to release the bolt.

2. Striking box according to claim 1 characterized in that the activating device comprises a rotary magnet (9, 29, 48) coupled to the bolt stop (4, 24, 45) with space (12, 32, 53) for motion.

3. Striking box according to claim 2 wherein said activating device comprises a flywheel (10, 49).

4. Striking box according to claim 2 characterized in that the bolt stop is formed by a lever (4) hinging in a fixed point (5).

5. Striking box according to claim 1 characterized in that the latch is provided with an electromagnetic drive mechanism (9, 29, 48) coupled to the activating device.

6. Striking box according to claim 1 wherein said activating device comprises a crank (30) and said latch (26) has a cam edge (43) and is biased by a spring (41) which latch and cam lies in the path of said crank (30) and can be pushed away by said crank against the action of said spring (41).

7. Striking box according to claim 3 characterized in that a pawl (50) has been provided on the flywheel (49), which pawl has been fitted on the flywheel between a stationary roller (55) and a recess (54) on an arm (52), in such a way that when the rotary magnet (48) is energized, pawl (50) is advanced between the roller (55) and the still unturned arm (52), and that when the energization of the magnet is discontinued the pawl moves along the roller, and in doing so engages the end of the recess (54) on the arm which has meanwhile been turned and returns the arm to its normal position.

8. Striking box according to claim 3 characterized in that the flywheel (10, 49) operates in conjunction with a mechanism (14, 59) which is coupled to the latch (6, 46) in order to move the latch at the beginning of the energization and at the end of the return stroke of such actuating device.

* * * * *